US006849034B2

(12) United States Patent
Eschenbach

(10) Patent No.: US 6,849,034 B2
(45) Date of Patent: Feb. 1, 2005

(54) TURNABOUT CLIMBER EXERCISE APPARATUS

(76) Inventor: Paul William Eschenbach, 290 S. Tyger La., Roebuck, SC (US) 29376

( * ) Notice: Subject to any disclaimer, the term of this patent is extended or adjusted under 35 U.S.C. 154(b) by 5 days.

(21) Appl. No.: 10/443,723

(22) Filed: May 23, 2003

(65) Prior Publication Data

US 2004/0235622 A1 Nov. 25, 2004

(51) Int. Cl.[7] ..... A63B 22/04

(52) U.S. Cl. ..... 482/52

(58) Field of Search ..... 482/51–53, 110, 482/111, 112, 121, 122, 126, 148, 57, 58, 62–65, 70, 79, 80, 908

(56) References Cited

U.S. PATENT DOCUMENTS

| | | | | | |
|---|---|---|---|---|---|
| 3,316,898 | A | | 5/1967 | Brown | 128/25 |
| 3,566,861 | A | | 3/1971 | Weiss | 128/25 |
| 3,628,791 | A | | 12/1971 | Garcia | 272/83 R |
| 3,747,924 | A | | 7/1973 | Champoux | 272/79 R |
| 3,792,860 | A | | 2/1974 | Selnes | 272/58 |
| 3,814,420 | A | | 6/1974 | Encke | 272/83 R |
| 4,053,173 | A | | 10/1977 | Chase, Sr. | 280/253 |
| 4,561,318 | A | | 12/1985 | Schirrmacher | 74/54 |
| 4,600,187 | A | | 7/1986 | Schenker | 272/70 |
| 4,708,338 | A | | 11/1987 | Potts | 272/70 |
| 4,830,362 | A | | 5/1989 | Bull | 272/70 |
| 4,934,688 | A | | 6/1990 | Lo | 272/70 |
| 4,961,570 | A | | 10/1990 | Chang | 272/73 |
| 4,989,858 | A | | 2/1991 | Young et al. | 272/70 |
| 5,013,031 | A | | 5/1991 | Bull | 272/70 |
| 5,076,572 | A | | 12/1991 | Wang | 272/70 |
| 5,135,447 | A | | 8/1992 | Robards, Jr. | 482/52 |
| 5,135,448 | A | | 8/1992 | Dunn et al. | 482/53 |
| 5,620,400 | A | | 4/1997 | Foster | 482/51 |
| 5,622,527 | A | | 4/1997 | Waterson et al. | 482/53 |
| 5,746,681 | A | | 5/1998 | Bull | 482/53 |
| 5,759,135 | A | | 6/1998 | Chen | 482/57 |
| 5,792,029 | A | | 8/1998 | Gordon | 482/52 |
| 5,810,696 | A | | 9/1998 | Webb | 482/52 |
| 5,924,963 | A | * | 7/1999 | Maresh et al. | 482/57 |
| 5,928,114 | A | * | 7/1999 | Chen | 482/57 |
| 5,971,892 | A | | 10/1999 | Lee | 482/52 |
| 6,017,294 | A | | 1/2000 | Eschenbach | 482/52 |
| 6,135,926 | A | * | 10/2000 | Lee | 482/57 |
| 6,482,130 | B1 | * | 11/2002 | Pasero et al. | 482/51 |
| 6,500,096 | B1 | * | 12/2002 | Farney | 482/52 |
| 6,582,343 | B2 | * | 6/2003 | Lin et al. | 482/53 |
| 6,719,665 | B1 | * | 4/2004 | Lai | 482/52 |
| 2001/0016542 | A1 | | 8/2001 | Yoshimura | |

* cited by examiner

*Primary Examiner*—Nicholas D. Lucchesi
*Assistant Examiner*—Tam Nguyen

(57) ABSTRACT

The present invention relates to a standup exercise apparatus that simulates in-place jogging and climbing with arm exercise. More particularly, the present invention relates to an exercise machine having separately supported pedals for the feet and arm exercise coordinated with the independent motion of the feet. A linkage is provided for each foot pedal to guide the pedal with reciprocating motion wherein the toe of the foot moves faster than the heel of the foot. Resistance is provided to resist the downward movement of the pedals. Handle movement is coordinated with the pedal movement for total body crosstraining. The handles can be moved or rendered stationary to provide turnabout exercise. Low knee stress allows long duration exercise without hurting knees common with some crosstrainers.

30 Claims, 3 Drawing Sheets

TURNABOUT CLIMBER EXERCISE APPARATUS

BACKGROUND OF THE INVENTION

1. Field

The present invention relates to a standup exercise apparatus that simulates jog-in-place and climbing with independent pedal movements plus coordinated arm exercise. More particularly, the present invention relates to an exercise machine having separately supported pedals for the feet and a variety of arm exercise coordinated with the motion of the feet. Turnabout exercise allows the user to assume an about-face position for different exercise.

2. State of the Art

The benefits of regular exercise to improve overall health, appearance and longevity are well documented in the literature. For exercise enthusiasts the search continues for safe apparatus that provides total body exercise for maximum benefit in minimum time.

Up and down foot motion has become popular in the stepper category where the heel of the foot generally moves faster than the toe. Webb in U.S. Pat. No. 5,810,696 shows a pedal linkage to guide the pedal and drive a flywheel. Young et al. in U.S. Pat. No. 4,989,858 show independent foot support members that are pivoted forward the operator while Bull in U.S. Pat. No. 5,013,031 shows similar dependent foot support members. Robards, Jr. et al. in U.S. Pat. No. 5,135,447 offers a dependent stepper with a forward pivoted foot support member to drive an alternator. Waterson et al. in U.S. Pat. No. 5,622,527 shows an independent stepper with damping cylinders. Wang in U.S. Pat. No. 5,076,572 adds arm exercise to an independent stepper while Bull in U.S. Pat. No. 4,830,362 adds arm exercise to an independent stepper with damping.

Bull in U.S. Pat. No. 5,746,681 and Lee in U.S. Pat. No. 5,971,892 show a pair of pedals each guided by a linkage for parallel pedal motion. Champoux in U.S. Pat. No. 3,747,924 offers dependent parallel pedal movements. Potts in U.S. Pat. No. 4,708,388 shows the classic independent stepper driving a flywheel. Schenker in U.S. Pat. No. 4,600,187 offers a dependent simulator for walking up steps while Garcia in U.S. Pat. No. 3,628,791 offers an independent jogger.

Dunn et al. in U.S. Pat. No. 5,135,448 use forward pivoted foot support members having paddles extending beyond the pivot for water exercise. Foster in U.S. Pat. No. 5,620,400 shows dependent forward pivot foot support members connected to hand levers for mountain climbing exercise. Chang in U.S. Pat. No. 4,961,570 shows dependent forward pivoted foot support members as part of a linkage having a crank to determine step range. Lo in U.S. Pat. No. 4,934,688 shows a dependent stepper that drives a flywheel.

The treadle category has the foot support members pivoted or guided rearward the operator allowing the foot to move up and down wherein the toe moves faster than the heel. Brown in U.S. Pat. No. 3,316,898 shows foot support members slidably pivoted rearward the operator with elliptical foot motion. Encke in U.S. Pat. No. 3,814,420 offers foot support members pivoted rearward the operator with treadle motion controlled by lever action. Yoshimura in U.S. Pat. Application No. US2001/0016542A1 shows a treadle foot movement with damping and foot treads. Selnes in U.S. Pat. No. 3,792,860 offers an independent treadle movement. Weiss in U.S. Pat. No. 3,566,861 adds arm exercise to treadle movement. Eschenbach in U.S. Pat. No. 6,017,294 offers rearward pivoted treadle pedal movement where the heel and toe curves have the same vertical slope.

Schirrmacher in U.S. Pat. No. 4,561,318 and Chase, Sr. in U.S. Pat. No. 4,053,173 show lever power systems to drive a bicycle with rearward pivoted foot levers. Chen in U.S. Pat. No. 5,759,135 offers rearward pivoted foot support levers that telescope with crank operation. Gordon in U.S. Pat. No. 5,792,029 shows rearward pivoting foot support members that support foot trolleys for back and forth foot motion coordinated by belts to up and down foot support member motion.

There remains a need to combine up and down inclined foot motion having low knee stress with changeable hand motion to exercise muscles in an alternative manner. There also remains a need for turnabout apparatus that allows exercise in the about-face position for the exercise of different muscles. There also remains a need for an exercise apparatus that provides climbing foot movements not found with stepper exercise apparatus.

SUMMARY OF THE INVENTION

The present invention relates to the kinematic motion control of pedals which simulates jog-in-place and climbing movements during operation. More particularly, apparatus is provided that offers variable intensity exercise through a leg operated reciprocating motion in which the pedal supporting each foot is guided through successive positions during the motion cycle while a load resistance acts upon the mechanism.

The pedals are guided through up and down inclined movement where the toe of the foot of an operator moves faster than the heel during the pedal cycle. The toe of the foot curve has a slope different than the heel curve. With turnabout exercise, the toe and heel curves are reversed for a different exercise. Arm exercise is by arm levers coordinated with the mechanism guiding the foot pedals.

In the preferred embodiment, the apparatus includes a pair of foot support members each having a foot engaging pedal supported by a pair of linkage that guides each pedal along inclined arcuate paths. Each linkage is comprised of a first pedal link and a second pedal link, each pedal link is pivotally connected to the foot support member and a frame. In the upper portion of the arcuate paths, the toe of the foot is above the heel while in the lower portion of the arcuate paths, the toe is below the heel to simulate a climbing movement. With turnabout exercise the toe and heel relationship is reversed.

Handles for arm exercise or hand support can be relocated to different positions for greater variety arm exercise or hand support. Resistance is provided by adjustable damping devices connected to the foot support members and frame to allow independent pedal movements. Shorter or longer pedal and handle movements are available to the user.

In an alternative embodiment, the damping devices are replaced with a flywheel driven by one-way clutches through chain and sprockets. An adjustable friction belt wrapped around the flywheel provides load resistance to ensure smooth motion. Of course, other forms of adjustable load resistance such as alternator, magnetic, air fan, etc. can be used in lieu of the friction belt.

In summary, this invention provides the operator with stable foot pedal support having adjustable intensity independent motions that simulate jog-in-place and climbing with very low joint impact and knee stress. The toe and heel movements are novel and not found in known steppers or climbers. Arm exercise can be varied or replaced with hand supports for greater variety arm exercise. Turnabout exercise allows reversed toe and heel movements for the exercise of different legs muscles.

BRIEF DESCRIPTION OF THE DRAWINGS

The foregoing and other objects and features of the present invention will become more fully apparent from the following description and claims, taken in conjunction with the drawings. Understanding that these drawings depict only typical embodiments of the invention and are, therefore, not to be considered limiting of its scope or combinations, the invention will be described with additional specificity and detail through use of the accompanying drawings in which:

DETAILED DESCRIPTION OF THE EMBODIMENTS

Figure 1:
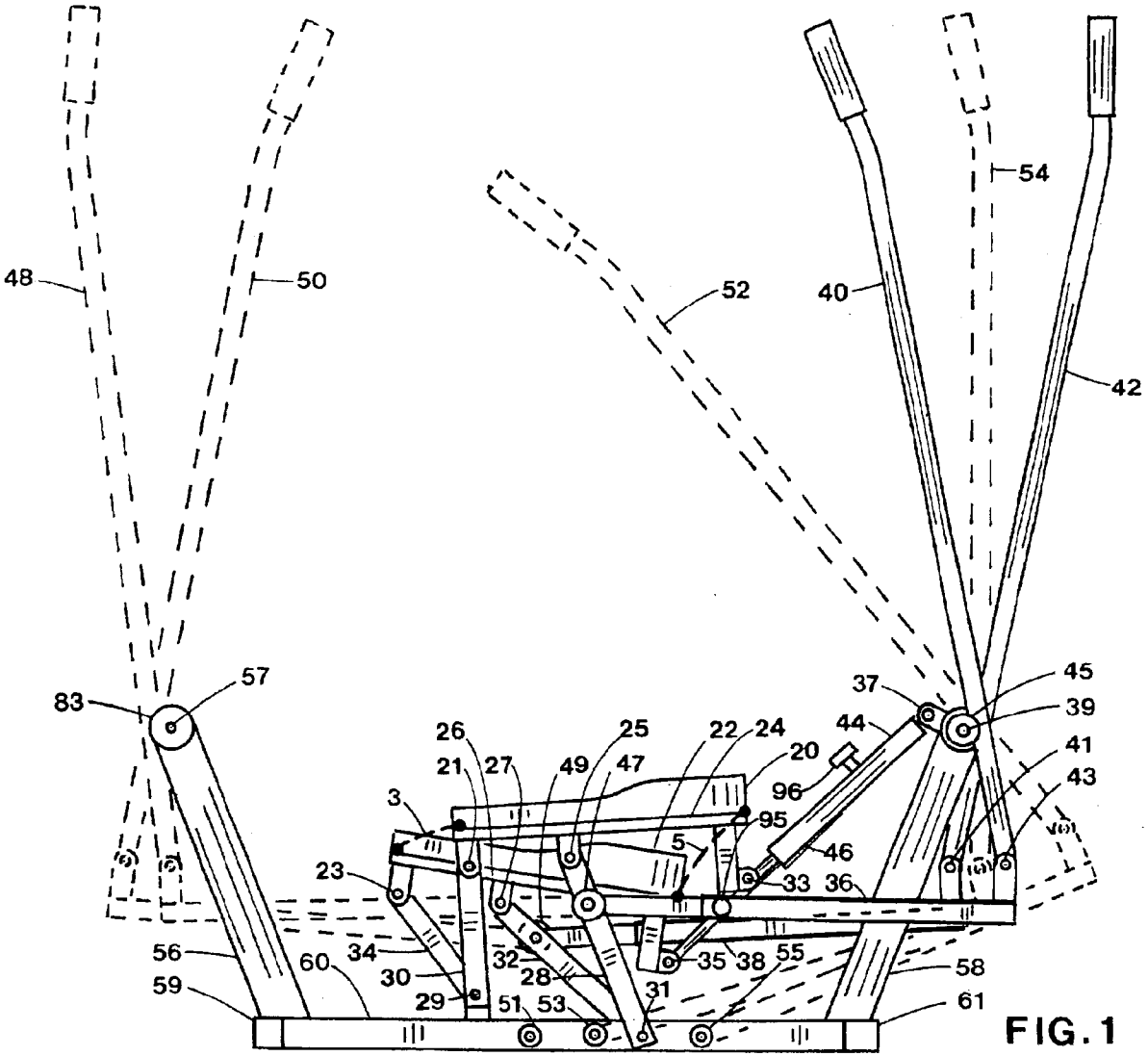
FIG. 1 is a right side elevation view of the preferred embodiment of an exercise machine constructed in accordance with the present invention.
Figure 2:
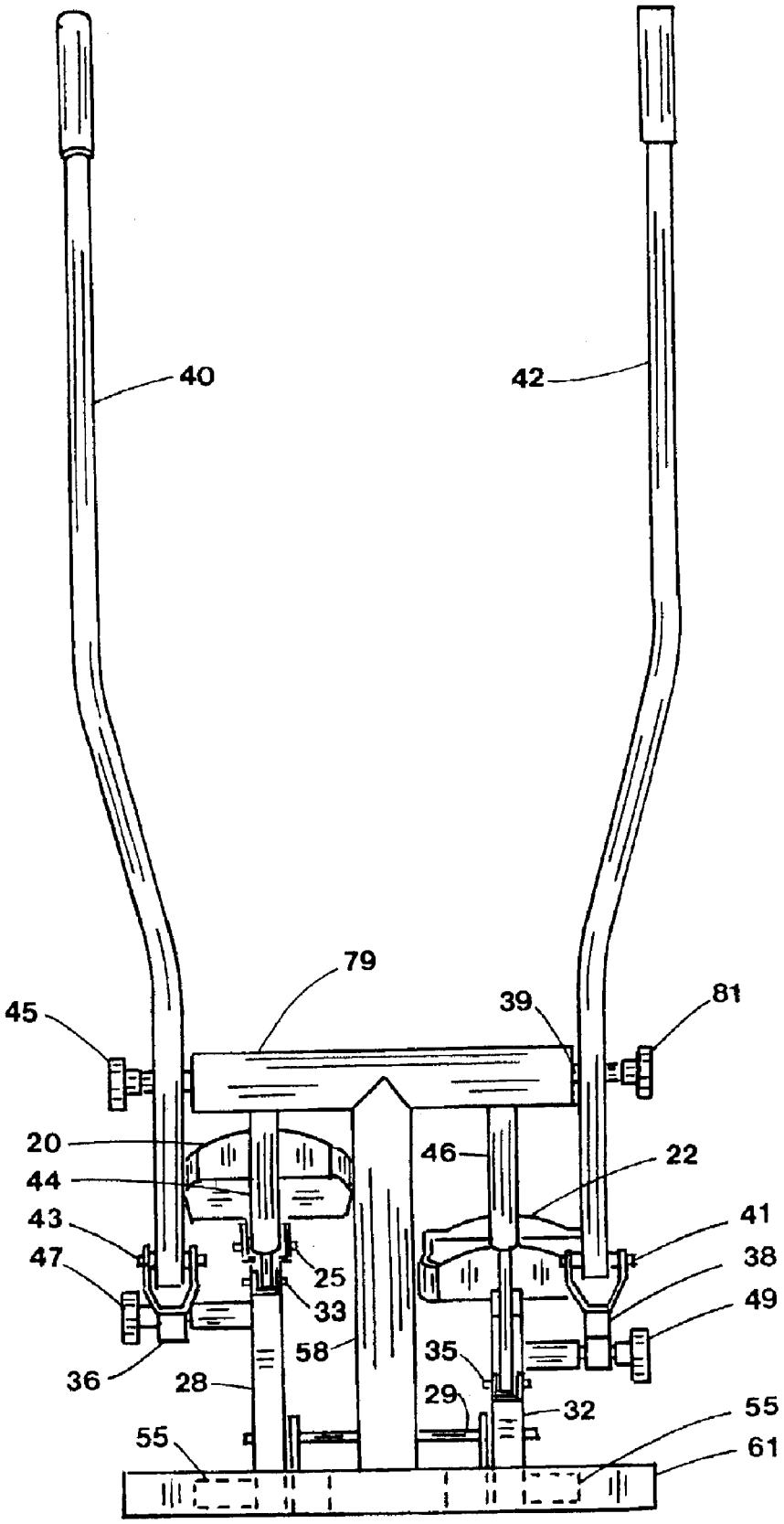
FIG. 2 is the front view of the preferred embodiment shown in FIG. 1.

Referring to the drawings in detail, pedals 20,22 are shown in FIGS. 1 and 2 in the upper and lower positions of the preferred embodiment. Pedals 20,22 are attached to foot support members 24,26. Pedal links 30,34 are connected to foot support members 24,26 at pivots 21,23 and to frame member 60 at pivots 29. Pedal links 28,32 are connected to foot support members 24,26 at pivots 25,27 and to frame member 60 at pivots 31. Pedal links 28,30 and foot support member 24 form a first linkage to guide pedal 20 along heel path 3 and toe path 5. Pedal links 32,34 and foot support member 26 form a second linkage to guide pedal 22 along heel path 3 and toe path 5. Note that heel curve 3 is shorter than the toe curve 5 and that each curve has a different slope.

Resistance is provided by damping cylinders 44,46 which are attached to foot support members 24,26 at pivots 33,35 and to frame member 79 at pivots 37. Each damping cylinder 44,46 has an adjustment 96 to vary the force required to lower pedals 20,22. Alternately, a single adjustment (not shown) could be used for both damping cylinders 44,46. Spring returns (not shown) internal to the damping cylinders 44,46 raise pedals 20,22 to their uppermost positions when the foot of a user is raised. Pedal 20 can be moved independently of pedal 22.

Handles 40,42 are connected to frame member 79 at pivots 39 to reciprocate for arm exercise in conjunction with the movements of pedals 20,22. Connector links 36,38 are connected to handles 40,42 at pivots 43,41 and to pedal links 28,32 at knobs 47,49. Connector links 36,38 are telescopically length adjustable by loosening knobs 95 whereby the reciprocation range of handles 40,42 can be repositioned relative to the user. In addition, handles 40,42 may become stationary at handle position 54 by relocating connector links 36,38 and knobs 47,49 to frame posts 53.

Turnabout exercise is provided when the user does an about-face on frame member 59. Handles 40,42 can be relocated to handle positions 48,50 by changing knobs 45,81 to pivots 57 and reorienting connector links 36,38. Posts 51 can be used to make handles 48,50 stationary by moving knobs 47,49. Alternately, handles 40,42 can be made stationary in handle position 52 by relocating knobs 47,49 to posts 55 for turnabout exercise hand support. Knobs 96,98 will also allow relocation of handles 40,42 for turnabout exercise. With the user in the turnabout position, the toe would follow curve 3 and the heel would follow curve 5. Note that the heel is above the toe with pedal 20 in the upper position and the heel is below the toe with pedal 22 in the lower position.

Frame 60 is attached to frame members 59,61 which are configured to rest upon a supporting surface. Upright supports 56,58 are attached to frame 60 and support frame members 79,83. Posts 51,53,55 are attached to both sides of frame 60.

Figure 3:
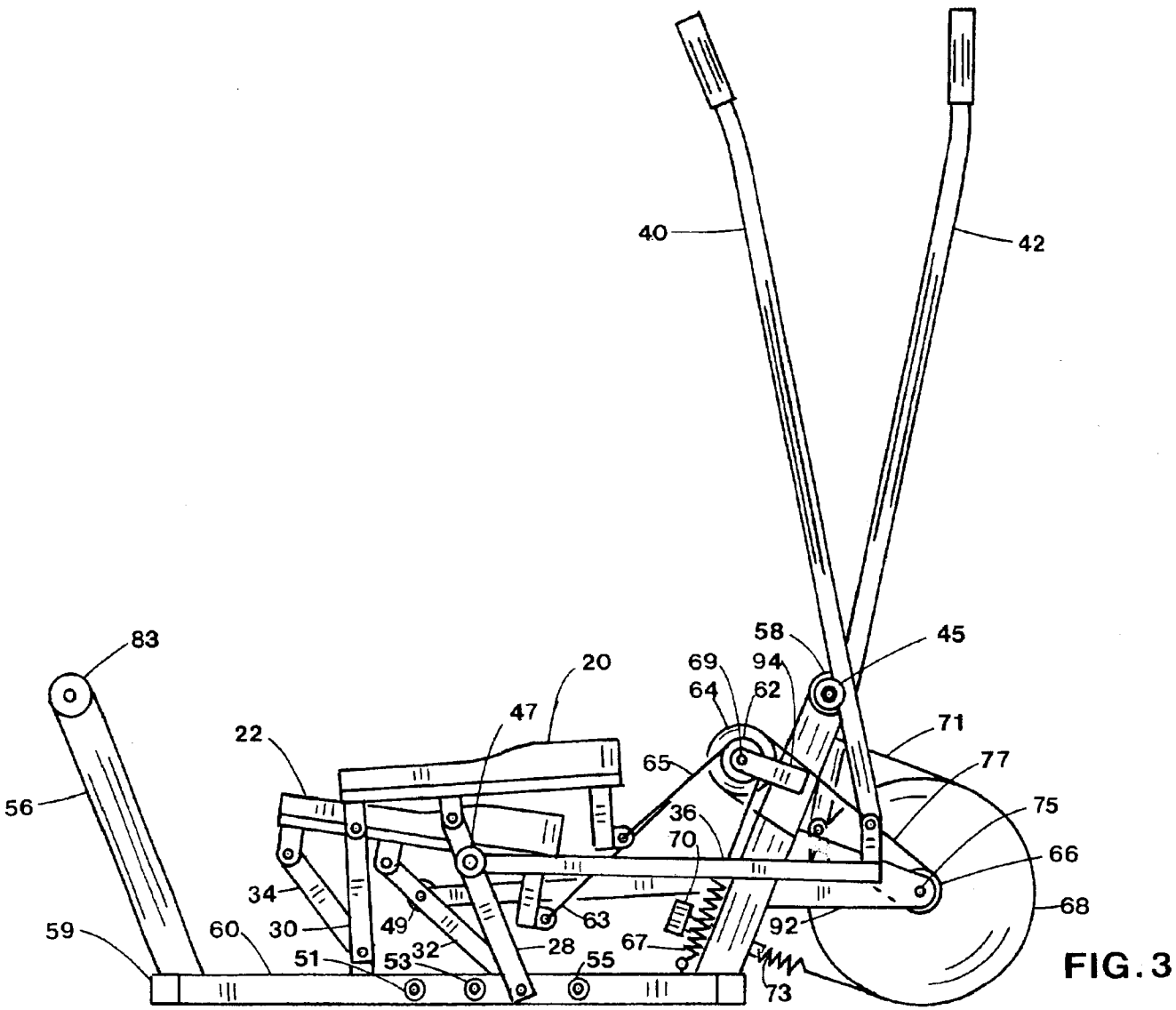
FIG. 3 is the right side elevation view of an alternate embodiment.

An alternate embodiment is shown in FIG. 3 with pedals 20,22 and handles 40,42 having similar movements as the preferred embodiment. Only the resistance system is changed where the damping cylinders 44,46 have been replaced by separate chains 63,65 which are connected to foot support members 24,26. Chains 63,65 engage sprockets 62 and attach to springs 67 that are secured to frame 60. Each sprocket 62 can rotate shaft 69 through one-way clutches (not shown). Sprocket 64 is attached to shaft 69 and is driven by sprockets 62 with the downward movements of pedals 20,22. Chain 77 engages sprocket 64 and sprocket 66 to drive flywheel 68. Resistance is provided by belt 71 wrapped around the circumference of flywheel 68. Adjustment knob 70 and spring 67 vary the resistance to rotation of flywheel 68.

Each pedal 20,22 can be moved independently of the other pedal for shorter or longer strokes. It is understood that other forms of resistance such as an alternator, magnetic, air fan, etc. can replace belt 71 with similar results. Further, it is understood that cables (not shown) can replace chains 63,65 with similar results. Handles 40,42 are coordinated with pedals 20,22 for corresponding shorter or longer strokes.

Upright support 56 is available to receive handles 40,42 for turnabout exercise similar to the preferred embodiment. Posts 51,53,55 are also available for stationary handle positions described in the preferred embodiment. Shaft 69 is supported by bracket 94 that is attached to upright support 58. Extensions 92 are attached to upright support 58 to support flywheel 68 at pivots 75.

The turnabout climber apparatus can be used for long periods because the knees do not hurt after extensive exercise, as is common for some users of steppers or elliptical crosstrainers. Pedals 20,22 provide heel curve 3 and toe curve 5 for climbing or jog-in-place foot movements quite different than steppers. Further, the turnabout feature reverses the heel 3 and toe 5 curves to exercise the leg muscles differently. In addition, the multiple positions for handles 40,42 offers a most versatile total body exercise apparatus.

The present invention may be embodied in other specific forms without departing from its spirit or essential characteristics. The described embodiments are to be considered in all respects only as illustrative, and not restrictive. The scope of the invention is, therefore, indicated by the claims, rather than by foregoing description. All changes which come within the meaning and range of equivalency of the claims are to be embraced within their scope.

What is claimed is:

1. A foot operated exercise apparatus comprising;

a frame, said frame configured to be supported by a supporting surface;

a pair of linkage, each said linkage comprising a plurality of links operably associated with said frame;

a pair of foot support members, each foot support member having a foot engaging pedal and being pivotally associated with a corresponding said linkage being positioned below said pedal;

said pedals being operably independent of each other;

each said linkage configured to guide said pedal with reciprocating movement relative to said frame along inclined arcuate paths having an upper and a lower portion when a foot of a user impinges upon said pedal whereby a toe of said foot is higher than a heel of said foot during said upper portion of said arcuate paths and said toe of said foot is below said heel of said foot during said lower portion of said arcuate paths.

2. The exercise apparatus according to claim 1 further comprising a pair of handles, each said handle operably associated with said corresponding pedal whereby said handle provides arm exercise.

3. The exercise apparatus according to claim 2 further comprising a pair of connector links, each said connector link pivotally connected to a corresponding said handle and to a corresponding linkage.

4. The exercise apparatus according to claim 3 wherein each said connector link further comprises an adjustment, said adjustment allowing the length of said connector links to be changed to reposition said handles.

5. The exercise apparatus according to claim 3 further comprising a set of frame posts, each said frame post available to secure one end of said connector link to change said moving handle into a stationary hand support.

6. The exercise apparatus according to claim 3 further comprising a set of knobs, said knobs useful to relocate said handles in an about-face position for turnabout exercise.

7. The exercise apparatus according to claim 1 further comprising a load resistance operably associated with said pedals.

8. The exercise apparatus according to claim 7 wherein said load resistance comprises a pair of damping cylinders, each said damping cylinder pivotally connected to a corresponding said foot support member and to said frame.

9. The exercise apparatus according to claim 1 further comprising a flywheel, said flywheel operably associated with said pedals.

10. The exercise apparatus according to claim 9 further comprising a load resistance, said load resistance operably associated with said flywheel.

11. The exercise apparatus according to claim 1 further comprising turnabout capability, said turnabout capability configured to allow a user to operate said exercise apparatus in the about-face mode.

12. A foot operated exercise apparatus comprising;

a frame, said frame configured to be supported by a supporting surface;

a pair of linkage, each said linkage comprising a plurality of links operably associated with said frame;

a pair of foot support members, each foot support member having a foot engaging pedal and being operably associated with a corresponding said linkage;

said pedals being operably independent;

a pair of handles, each said handle operably associated with a corresponding said pedal for arm exercise;

each said linkage configured to guide said pedal with reciprocating movement relative to said frame along inclined arcuate paths when a foot of a user impinges upon said pedal whereby a toe of said foot moves faster than a heel of said foot along a portion of said arcuate paths while said handle reciprocates for arm exercise.

13. The exercise apparatus according to claim 12 further comprising a pair of connector links, each said connector link pivotally connected to a corresponding said handle and to a corresponding linkage.

14. The exercise apparatus according to claim 13 wherein each said connector link further comprises an adjustment, said adjustment allowing the length of said connector links to be changed to reposition said handles.

15. The exercise apparatus according to claim 13 further comprising a set of frame posts, each said frame post available to secure one end of said connector link to change said moving handle into a stationary hand support.

16. The exercise apparatus according to claim 13 further comprising a set of knobs, said knobs useful to relocate said handles in an about-face position for turnabout exercise.

17. The exercise apparatus according to claim 12 further comprising a load resistance, said load resistance operably associated with said pedals.

18. The exercise apparatus according to claim 17 wherein said load resistance comprises a pair of damping cylinders, each said damping cylinder pivotally connected to a corresponding said foot support member and to said frame.

19. The exercise apparatus according to claim 12 further comprising a pair of springs, each said spring operably associated with a corresponding said pedal and said frame to raise said pedal after use.

20. The exercise apparatus according to claim 12 further comprising a flywheel, said flywheel operably associated with said pedals.

21. The exercise apparatus according to claim 20 further comprising a load resistance, said load resistance operably associated with said flywheel.

22. The exercise apparatus according to claim 12 further comprising turnabout capability, said turnabout capability configured to allow a user to operate said exercise apparatus in the about-face mode.

23. A foot operated exercise apparatus comprising;

a frame, said frame configured to be supported by a supporting surface;

a pair of first links, each said first link pivotally connected to said frame;

a pair of second links, each said second link pivotally connected to said frame;

a pair of foot support members, each foot support member having a foot engaging pedal and being pivotally connected with corresponding said first and said second links below said pedal;

a load resistance, said load resistance operably associated with each pedal to resist downward movement of each said pedal;

each said first and said second links configured to guide said pedal with independent reciprocating movement relative to said frame along inclined arcuate paths having an upper portion and a lower portion when a foot of a user impinges upon said pedal whereby a toe of said foot is higher than a heel of said foot during said upper portion of said arcuate paths and said toe of said foot is below said heel of said foot during said lower portion of said arcuate paths.

24. The exercise apparatus according to claim 23 further comprising a pair of handles, each said handle operably associated with said corresponding pedal whereby said handle provides arm exercise.

25. The exercise apparatus according to claim 23 further comprising a pair of connector links, each said connector link pivotally connected to a corresponding said handle and to a corresponding linkage.

26. The exercise apparatus according to claim 25 wherein each said connector link further comprises an adjustment, said adjustment allowing the length of said connector links to be changed to reposition said handles.

27. The exercise apparatus according to claim 25 further comprising a set of posts, each said post available to secure one end of said connector link to change said moving handle into a stationary hand support.

28. The exercise apparatus according to claim 24 wherein said load resistance comprises a pair of adjustable damping cylinders, each said adjustable damping cylinder pivotally connected to a corresponding said foot support member and to said frame to resist the movement of said handle.

29. The exercise apparatus according to claim 23 further comprising a flywheel, said flywheel operably associated with said pedals.

30. The exercise apparatus according to claim 23 further comprising turnabout capability, said turnabout capability configured to allow a user to operate said exercise apparatus in the about-face mode.

* * * * *